US005773757A

United States Patent [19]

Kenney et al.

[11] Patent Number: 5,773,757

[45] Date of Patent: Jun. 30, 1998

[54] RETRACTABLE ELECTRICAL POWER CORD APPARATUS

[75] Inventors: John A. Kenney, Oklahoma City; Harold F. Reherman, Kingfisher, both of Okla.

[73] Assignee: Pembroke Properties, Inc., Oklahoma City, Okla.

[21] Appl. No.: 695,581

[22] Filed: Aug. 12, 1996

[51] Int. Cl.[6] ..... H01H 9/02

[52] U.S. Cl. ..... 174/53; 220/3.3; 439/501

[58] Field of Search ..... 242/389, 397, 242/398; 439/501; 174/53, 57, 48, 50, 66; 220/3.3, 3.7, 3.8

[56] References Cited

U.S. PATENT DOCUMENTS

| | | | |
|---|---|---|---|
| 1,018,297 | 2/1912 | Carstarphen, Jr. . | |
| 2,585,070 | 2/1952 | Allard | 200/153 |
| 2,912,525 | 11/1959 | Ures | 191/12.2 |
| 3,700,834 | 10/1972 | Schaefer | 191/12.2 R |
| 3,773,969 | 11/1973 | Geisel | 174/65 |
| 3,811,004 | 5/1974 | Moore | 174/67 |
| 3,837,448 | 9/1974 | Hagstrom | 191/12.4 |
| 4,114,736 | 9/1978 | Scherenberg | 191/12.4 |
| 4,141,104 | 2/1979 | Watso | 16/65 |
| 4,467,979 | 8/1984 | Koehler | 242/96 |

OTHER PUBLICATIONS

Griot's Garage, p. 36, 1995.

*Primary Examiner*—Kristine L. Kincaid
*Assistant Examiner*—Dhiru R. Patel
*Attorney, Agent, or Firm*—Dougherty & Hessin, P.C.

[57] ABSTRACT

The retractable electric power cord apparatus of the present invention can be mounted within a wall space between a pair of vertical studs forming a wall. The retractable cord apparatus includes a frame sized to be positioned and attached within the wall space by way of an opening formed in the wall, a door pivotally connected to the frame and an electric power cord. A spool for extending and retracting the electric power cord is connected to an inside of the door such that the spool has an axis of rotation perpendicular to the door and is sized to fit within the frame.

28 Claims, 1 Drawing Sheet

RETRACTABLE ELECTRICAL POWER CORD APPARATUS

BACKGROUND OF THE INVENTION

This invention relates generally to retractable cord apparatus and more particularly, but not by way of limitation, to extendable and retractable electrical power cord apparatus which can be mounted flush to a wall and which facilitate the extension, retraction and storage of an electrical extension cord.

Electrical extension cords (also known simply as extension cords) are commonly used to supply electrical power to a remote location, i.e., to a place away from an electrical outlet, such as for electrical appliances and tools. Common problems associated with electrical extension cords and their use include tangling of the cord, difficulty extending the cord, difficulty retracting and storing the cord and unsightliness of cords and their storage containers.

Prior art retractable electrical extension cord devices have attempted to solve some of these problems. Such devices typically include a spool for winding an electrical extension cord. The spool, which may be disposed in a housing, often includes a spring-loaded mechanism to aid in winding and unwinding the extension cord. Other prior art devices use a manually rotatable spool to wind the electrical extension cord.

While these prior art electrical extension cord devices perform adequately in many circumstances, problems and shortcomings still exist. For example, prior art electrical extension cord devices generally are not adapted to be mounted flush with a wall, are inconvenient, difficult to use, unstable and unsightly.

Thus, there is the need for a retractable electrical extension cord apparatus which will conveniently, easily and efficiently extend, retract and store an electric extension cord, which is stable and which can be mounted substantially flush with a wall such that the spool and extension cord can be concealed in the wall. Therefore, there is the more general need for improved electrical power cord apparatus.

SUMMARY OF THE INVENTION

The present invention provides improved retractable cord apparatus which meet the need described above and overcome the shortcomings of the prior art.

The retractable electric power cord apparatus of the present invention is adapted to be mounted within a wall space between a pair of vertical studs forming a wall. It includes a frame sized to be positioned and attached within the wall space by way of an opening formed in the wall, a door pivotally connected to the frame and an electric power cord. The retractable electric power cord apparatus also includes a spool for extending and retracting the electric power cord connected to an inside of the door and sized to fit within the frame, wherein the electric power cord is connected to and wound on the spool.

The retractable electric power cord apparatus of the present invention is adapted to be mounted substantially flush with a wall and includes a frame sized to be received in an opening in a wall within a wall space between a pair of vertical studs forming the wall, a hinge attached to the frame, a door attached to the hinge such that the door is pivotal with respect to the frame and an electric power cord for conveying electrical power from a plug end to a receptacle end. The apparatus of the present invention also includes a spool for extending and retracting the electric power cord, the spool sized to be positioned within a frame and attached to an inside of the door such that the spool has an axis of rotation substantially perpendicular to the door.

It is therefore a general object of the present invention to provide improved retractable electrical power cord apparatus. Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
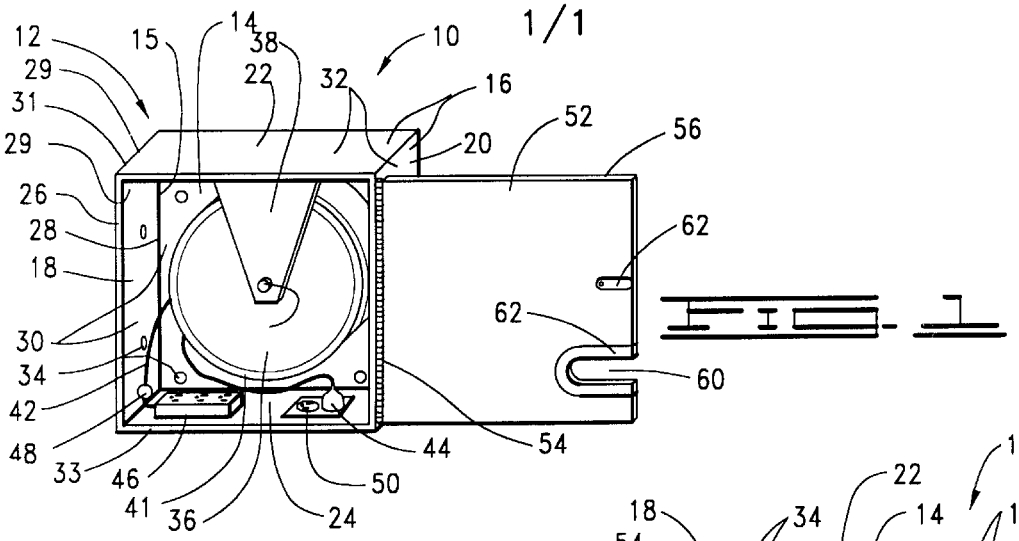
FIG. 1 is a perspective view of an embodiment of the retractable electrical power cord apparatus of the present invention.

Referring to the drawings, presently preferred embodiments of the invention and their operation are illustrated. Like reference numerals refer to like parts throughout the drawings and this description.

Referring to FIG. 1, a presently preferred retractable electrical power cord apparatus is illustrated and designated generally by the numeral 10. Apparatus 10 includes a frame 12 which, in a preferred embodiment, resembles a rectangular-shaped, open-top box. Frame 12 comprises a back portion 14 and side portions 16. Back portion 14 is rectangular in shape and includes edges 15. Side portions 16 include a left side 18, a right side 20, a top side 22 and a bottom side 24. Directional references herein are used solely for simplicity and do not limit the invention to any particular orientation. In fact, apparatus 10 can be used in any orientation.

Side portions 16 have a proximal edge 26, a distal edge 28 and opposed ends 29. Side portions 16 and back portion 14 have an inside surface 30 and an outside surface 32. Frame 12 may also include lip 33 connected to proximal edge 26 of side portions 16.

With respect to the orientation of frame 12, left side 18 is substantially parallel to right side 20. Likewise, top side 22 is substantially parallel to bottom side 24. Adjacent side portions 16 are connected at approximate 90° angles. Thus, for example, an end 29 of top side 22 is perpendicularly connected to an end 29 of left side 18 to form a corner 31. Other adjacent side portions 16 are similarly connected as illustrated in FIG. 1. Edges 15 of back portion 14 are connected to distal edge 28 of side portions 16.

Frame 12 has a size such that it can be positioned within the wall space by way of an opening formed in the wall and attached in this position. That is, frame 12 can fit between a pair of adjacent vertical studs forming a wall and within a standard depth wall clearance. Frame 12 includes apertures 34 disposed through back portion 14 and side portions 16, particularly left side 18 and right side 20, such that apparatus 10 can be mounted within a wall space between a pair of vertical studs forming a wall or to the outside of a wall as explained fully herein. Knockouts can be used instead of apertures 34.

Frame 12 can be constructed of virtually any material including metal, plastic, wood and various composite materials. Furthermore, while frame 12 has been described as rectangular-shaped, it is recognized that other shapes, such as circular, are also suitable.

Apparatus 10 also includes a spool 36 which is sized to be positioned within and adapted to be received in frame 12. That is, the distance between opposite side portions 16 of frame 12 is not less than the diameter (if circular) of the spool 36. In the embodiment shown in FIG. 1, spool 36 is attached to inside surface 30 of frame 12 by attaching means such as a bracket 38 connected to frame 12 by a screw 40.

Spool 36 is for extending (unwinding) and retracting (winding) an electrical power cord 42. Spool 36 is attached such that an axis of rotation of spool 36 is substantially perpendicular to the wall when apparatus 10 is mounted to the wall. Such an orientation of the axis of rotation of spool 36 allows for more cord 42 to be wound on spool 36 as compared to a spool 36 having an axis of rotation parallel to the wall which would require a long spool and a means for evenly guiding cord 42 on the long spool. The length of cord 42 which can be accommodated by spool 36 depends on the diameter of cord 42. For example, if electrical extension cord 42 has a standard diameter, approximately one hundred feet or more can be accommodated on spool 36.

Electrical extension cord 42 has a plug end 44 and a receptacle end 46 and can convey electrical power from plug end 44 to receptacle end 46. Cord 42 may also have stopping means such as ball 48 which prevents receptacle end 46 from being wound around spool 36.

Retractable electrical extension cord devices are commercially available in several forms. Some of these devices use a spring-loaded ratchet mechanism which allows the extension cord to be extended, holds the extension cord in the extended position and automatically winds the extension cord about a spool when the spring-loaded ratchet mechanism is released. In other forms, the electrical extension cord is wound about a spool manually such as by a hand crank. Some of the commercially available retractable electrical extension cord devices also have a housing 41 which conceals the wound cord and various brackets or other means for mounting the electrical extension cord spools. As used herein, "spool" may include such housing 41 as well as additional features possessed by the commercially available extension cord devices. Many of these commercially available retractable electrical extension cord devices can be incorporated as the spool 36 of the present invention with little or no modification. Such retractable electrical extension cord devices are readily available at retail stores such as Home Depot and through mail order catalogs such as Groits' Garage. If cord 42 becomes worn or if spool 36 becomes defective, cord 42 and spool 36 can simply be replaced as a unit.

An electrical outlet 50 can also be incorporated into the present invention. As illustrated in FIG. 1, electrical outlet 50 is positioned substantially flush with bottom side 24 of frame 12. Electrical outlet 50, which can be mounted to other areas of frame 12 as well, provides a connection location for plug end 44 of cord 42 as well as connection locations for other extension cords or other uses. Electrical outlet 50 is wired to a power source such as a 110-volt circuit. Another method of providing electrical power to apparatus 10 is to permanently wire or hardwire plug end 44 of cord 42 to a power source.

Apparatus 10 further comprises a door 52 pivotally connected to frame 12 such as by a hinge 54. Door 52 may include a lip 56 for matingly receiving or abutting outside surface 32 of proximal edge 26 of side portions 16 of frame 12 or for matingly receiving or abutting lip 33 of frame 12. Door 52 may also include a latch mechanism 58 for securing door 52 to a part of frame 12 such that door 52 can be locked in a closed position. When apparatus 10 is mounted within a wall, in the closed position, door 52 is substantially flush with the wall.

Door 52 may also include a slot 60 for receiving cord 42. In the embodiment illustrated in FIG. 1, cord 42 can be extended and retracted through slot 60 when door 52 is in the closed position, i.e., when door 52 or lip 56 of door 52 abuts frame 12 or lip 33 of frame 12 or when latch mechanism 58 engages a part of frame 12. Preferably, border 62 surrounding slot 60 is covered with a plastic, rubber or other material which reduces the friction between the border 62 of slot 60 and cord 42 to prevent excessive wear to cord 42. Roller mechanisms (not shown) can also be used to accomplish the same purpose.

Figure 2:
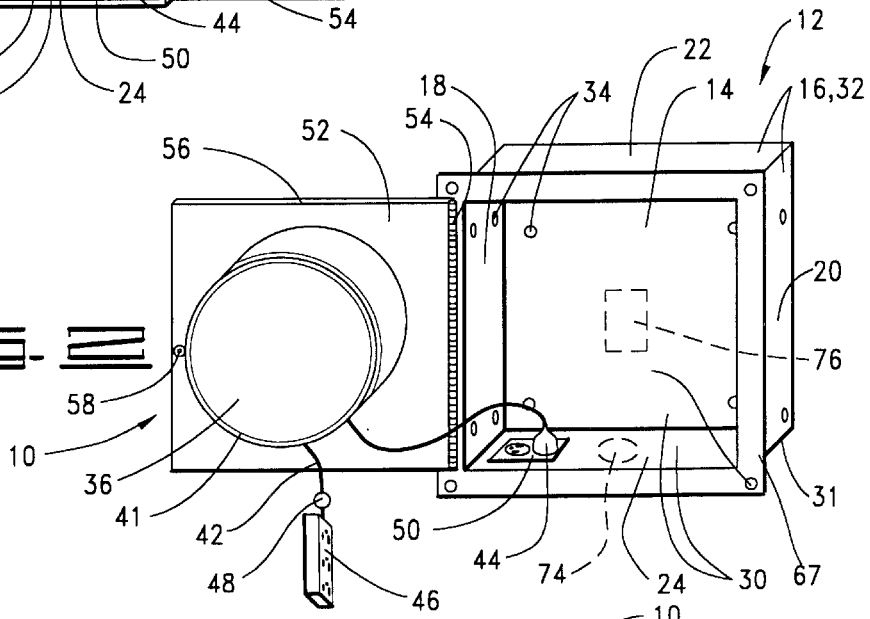
FIG. 2 is a perspective view of an alternate embodiment of the present invention.

Referring to FIG. 2, another presently preferred embodiment of the retractable cord apparatus is illustrated and generally designated by the numeral 10. This embodiment of apparatus 10 includes a frame 12 substantially as described before with respect to FIG. 1. However, it is noted that the structure of frame 12 can be simplified by omitting portions of the structure. In other words, while the rectangularshaped, open-top box frame 12 is structurally sound and aesthetically pleasing, portions of frame 12 can be eliminated while still retaining the same function of the frame. Thus, for example, frame 12 may consist only of left side 18 such that door 52 attaches to left side 18 by hinge 54. Even with such a simplified frame structure, as defined herein, spool 36 is considered to be sized to fit within frame 12 and adapted to be received in frame 12 when spool 36 can be received in an opening in a wall to which apparatus 10 is attached.

In the embodiment illustrated in FIG. 2 apparatus 10 also includes spool 36, cord 42, electrical outlet 50 and door 52 and other elements as have been described herein. A distinction between the embodiment illustrated in FIG. 1 and the embodiment illustrated in FIG. 2 lies in the arrangement of the elements.

As shown in FIG. 2, spool 36 is attached to door 52 (rather than to frame 12 as shown in the embodiment illustrated in FIG. 1). The axis of rotation of spool 36 is preferably oriented perpendicular to door 52. Such an orientation allows door 52 of apparatus 10 to be mounted substantially flush with a wall and allows for more cord 42 to be wound on spool 36 as previously discussed herein. Thus, apparatus 10 is adapted to be mounted within a standard depth wall space (which is typically either three and one-half inches if the walls are formed of "2×4's" or five and one-half inches if the walls are formed of "2×6's") and between a pair of standardly located adjacent vertical wall studs (which is typically 16 inches between the centers of adjacent studs).

When the axis of rotation of spool 36 is perpendicular to door 52, the axis of rotation of spool 36 is variable with respect to the wall to which apparatus 10 is mounted. In other words, when door 52 pivots on hinge 54 relative to frame 12, the axis of rotation of spool 36 remains substantially perpendicular to door 52 but varies with respect to frame 12 and with respect to a wall (when attached to a wall). Due to the changing axis of rotation, door 52 (to which spool 36 is attached) will generally align in the direction in which cord 42 is pulled. This feature aids in the extension, retraction and use of cord 42 by keeping the unwound cord 42 tangential to the cord 42 which is wound around spool 36. Thus, cord 42 is less likely to be put in a bind when spool 36 is extending or retracting cord 42. This feature also aids in the use of the receptacle end 46 of cord 42 at any point in a semi-circle to which cord 42 will extend.

Apparatus 10 as shown in FIG. 2 may comprise means for retaining door 52 in a predetermined open position. Such means includes a groove for receiving a lower portion of door 52, other friction devices and spring resistant mechanisms as well as equivalents thereof which act to resist or stop the pivotal action of door 52. Means for retaining door 52 can also include a frictional hinge 54 constructed such that frictional forces acting upon hinge 54 resist the movement of door 52 relative to frame 12 when cord 42 is being extended from spool 36.

Apparatus 10 may also include a face plate 66 attached toward proximal edge 26 of outside surfaces 32 of side portions 16 of frame 12. Face plate 66 covers the edges of an opening in the wall and abuts the wall when frame 12 is positioned in the opening of the wall. Face plate 66 may comprise means for attaching apparatus to a wall such as holes 67 disposed through face plate 66 for receiving screws, nails, etc.

Figure 3:
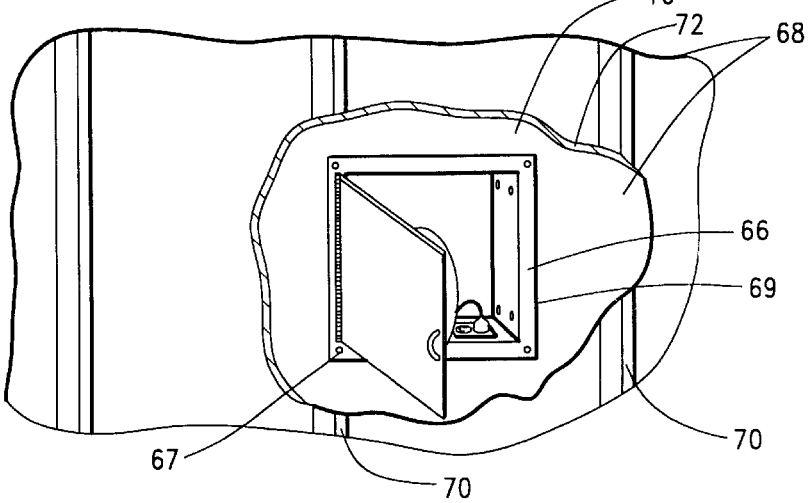
FIG. 3 is a partially sectioned view of a wall with an embodiment of the present invention shown mounted thereto.

Referring to FIG. 3, apparatus 10 is shown mounted substantially flush with a wall 68. Apparatus 10 is mounted within a wall space between a pair of vertical studs 70 forming wall 68.

Apparatus 10 is mounted to wall 68 by cutting a hole or opening in wall covering 72 (such as gypsum board) slightly larger than the size of frame 12 of apparatus 10, but smaller than the outside perimeter 69 of face plate 66. Apparatus 10 can be positioned in the opening formed in wall 68 and attached flush to wall 68 by screws, nails, etc., disposed through apertures 34 in frame 12 and into, preferably, at least one wall stud 70. Thus, as illustrated in FIG. 3, screws may be disposed through apertures 34 in left side 18 of side portion 16 of frame 12 (see FIG. 2) and into wall stud 70. As indicated herein, apparatus 10 can also be attached by screws disposed through holes 67 in face plate 66 and into wall covering 72 and/or a wall stud 70. When mounted, face plate 66 abuts wall covering 72 of wall 68 and covers any gap between outside surface 30 of side portions 16 of frame 12 and the opening cut in wall 68.

Apparatus 10 can also be mounted external to a wall instead of flush. In an external mounting arrangement, screws disposed through apertures 34 in back portion 14 of frame 12 (see FIG. 2) and into a wall stud 70 or wall covering 72 secure apparatus 10 to wall 68. When apparatus 10 is externally mounted, face plate 66 can either be eliminated or relocated from proximal edge 26 of side portions 16 to distal edge 28 of side portions. An electrical wire or extension cord (including, for example, plug end 44 of cord 42) disposed through an aperture or knockout 74 in side portions 64 (see FIG. 2) provides means for connecting electrical power to apparatus 10. Back portion 14 can also have an aperture or knockout 76 (see FIG. 2) sized and shaped approximately the same as a standard wall-mounted electrical outlet 78 (see FIG. 2 ) so that apparatus 10 can be mounted over the outlet for a convenient way to provide electrical power to apparatus 10. Thus, a standard electrical power outlet can communicate with and supply electrical power to a plug end 44 of cord 42 through knockout 76 in back portion 14. Similarly, apparatus 10 with a frame 12 having no back portion 14 could be mounted over a standard wall-mounted electrical outlet such that plug end 44 of cord 42 could simply connect to the outlet.

When attached to or within wall 68 as discussed and illustrated herein, apparatus 10 can be used to provide electrical power to a remote location such as to the center of a garage, to the driveway, or to other locations which are separated from an electrical outlet where an electrical extension cord would ordinarily be used. First, a receptacle end 46 of cord 42 extending from spool 36 is exposed. Receptacle end 46 of cord 42 can be exposed either by opening door 52 or by positioning cord 42 in slot 60 in door 52.

Next, cord 42 is unwound until receptacle end 46 is near the desired remote location. Cord 42 can be unwound by pulling receptacle end 46 toward the remote location. When receptacle end 46 is positioned in the desired location, electrical appliances and power tools, etc., can be connected to receptacle end 46 and can be used.

Cord 42 can be wound and stored by releasing the spring-loaded ratchet mechanism or manually cranking spool 36 until receptacle end 46 is near spool 36. Receptacle end 46 can be positioned within frame 12 such that door 52 can be closed to conceal spool 36 and cord 42.

While the present invention has been discussed in terms of an electrical power cord apparatus, it is recognized that this invention is beneficial to other applications such as cords which convey fluid substances such as water and oil.

Thus, the present invention is well adapted to carry out the objects and attain the ends and advantages mentioned as well as those inherent therein. While preferred embodiments of the present invention have been illustrated for the purpose of the present disclosure, changes in the arrangement and construction of parts and the performance of steps can be made by those skilled in the art, which changes are encompassed within the scope and spirit of the present invention as defined by the appended claims.

What is claimed is:

1. A retractable electric power cord apparatus comprising:

a frame adapted to be mounted substantially flush to a wall;

a door pivotally connected to said frame;

an electrical power cord sized to fit within said frame and behind said door; and a spool for extending and retracting said electrical power cord, said spool sized to be positioned within said frame and attached to an inside of said door such that an axis of rotation of said spool is substantially perpendicular to said door and remains substantially perpendicular to said door when said door is pivoted relative said frame wherein said axis of rotation of said spool varies with respect to said frame.

2. The apparatus of claim 1 wherein a back portion of said frame includes an aperture through which a standard electrical power outlet mounted to the wall can communicate with and supply electrical power to a plug end of said electrical power cord.

3. The apparatus of claim 1 further comprising a face plate attached to an outside of said frame for abutting the wall when said frame is attached to the wall.

4. The apparatus of claim 1 further comprising an outlet mounted to said frame for supplying electrical power to the electrical power cord.

5. The apparatus of claim 1 further comprising means for retaining said door in a predetermined open position.

6. The apparatus of claim 1 further comprising a slot for receiving said electrical power cord such that said electrical power cord can be extended and retracted with said door in a closed position.

7. A retractable electric power cord apparatus adapted to be mounted within a wall space between a pair of vertical studs forming a wall comprising:

a frame sized to be positioned and attached within the wall space by way of an opening formed in the wall;

a door pivotally connected to said frame;

an electric power cord; and a spool for extending and retracting said electric power cord, said spool connected to an inside of said door and sized to fit within said frame, said electric power cord connected to and wound on said spool.

8. The apparatus of claim 7 wherein said spool has an axis of rotation perpendicular to said door.

9. The apparatus of claim 7 wherein said frame is rectangularly shaped.

10. The apparatus of claim 7 further comprising a slot in said door for receiving said electrical power cord.

11. The apparatus of claim 7 further comprising a face plate attached to said frame for abutting the wall when said frame is positioned in the opening in the wall.

12. The apparatus of claim 7 further comprising means for retaining said door in a predetermined open position.

13. The apparatus of claim 7 further comprising an electrical outlet mounted to said frame for supplying electrical power to said electrical power cord.

14. A retractable electric power cord apparatus adapted to be mounted substantially flush with a wall comprising:

a frame sized to be received in an opening in a wall within a wall space between a pair of vertical studs forming the wall;

a hinge attached to said frame;

a door attached to said hinge such that said door is pivotal with respect to said frame;

an electrical power cord having a plug end and a receptacle end for conveying electrical power from the plug end to the receptacle end;

a spool for extending and retracting said electric power cord, said spool sized to be positioned within said frame and attached to an inside of said door such that said spool has an axis of rotation substantially perpendicular to said door.

15. The apparatus of claim 14 wherein said door comprises a slot for receiving said electrical power cord.

16. The apparatus of claim 14 wherein the axis of rotation of said spool is variable with respect to the wall.

17. The apparatus of claim 14 further comprising means for retaining said door in a predetermined open position.

18. The apparatus of claim 14 further comprising a face plate attached to said frame for abutting the wall when said frame is positioned in the opening in the wall.

19. The apparatus of claim 14 wherein said frame is rectangularly shaped.

20. The apparatus of claim 14 further comprising an electrical outlet mounted to said frame for supplying electrical power to said plug end of said electrical power cord.

21. A retractable electric power cord apparatus comprising:

a frame adapted to be mounted to a wall;

a door pivotally connected to said frame;

an electrical power cord sized to fit within said frame and behind said door;

a spool for extending and retracting said electrical power cord, said spool sized to be positioned within said frame; and removable attaching means for securing said spool to an inside of said door such that an axis of rotation of said spool is substantially perpendicular to the wall when such frame is mounted to the wall and said door is in closed position.

22. The apparatus of claim 21 wherein a back portion of said frame includes an aperture through which a standard electrical power outlet mounted to the wall can communicate with and supply electrical power to a plug end of said electrical power cord such that said standard electrical power outlet is concealed by said frame when said frame is mounted to the wall.

23. The apparatus of claim 22 further comprising a face plate attached to an outside of said frame for abutting the wall when said frame is attached to the wall.

24. The apparatus of claim 23 further comprising an outlet box mounted to said frame.

25. The apparatus of claim 24 further comprising means for retaining said door in a predetermined open position.

26. The apparatus of claim 25 further comprising a slot for receiving said electrical power cord such that said electrical power cord can be extended and retracted with said door in a closed position.

27. The apparatus of claim 26 wherein a longitudinal axis of said slot is substantially parallel to the axis of rotation of said spool.

28. The apparatus of claim 27 wherein said axis of rotation of said spool is substantially perpendicular to said door.

* * * * *